United States Patent [19]

Holdt

[11] Patent Number: 4,691,962

[45] Date of Patent: Sep. 8, 1987

[54] CONVERTIBLE WHEELCHAIR/LITTER

[75] Inventor: Donald H. Holdt, Cambridge, Md.

[73] Assignee: Cambridge Technologies, Inc., Cambridge, Md.

[21] Appl. No.: 886,008

[22] Filed: Jul. 16, 1986

Related U.S. Application Data

[62] Division of Ser. No. 673,850, Nov. 21, 1984.

[51] Int. Cl.[4] ..... A47C 1/02

[52] U.S. Cl. ..... 297/84; 297/219; 297/DIG. 4

[58] Field of Search ..... 297/444, 440, 455, 218, 297/DIG. 4, 219, 84

[56] References Cited

U.S. PATENT DOCUMENTS 1,657,285 1/1928 Siskin ..... 297/444 X 4,032,191 6/1977 Fetsch ..... 297/440

4,365,840 12/1982 Kehl ..... 297/444 X 4,564,238 1/1986 Wolpert, Jr. ..... 297/440 X

FOREIGN PATENT DOCUMENTS 80551 8/1952 Norway ..... 297/444

*Primary Examiner*—James T. McCall

*Attorney, Agent, or Firm*—Roylance, Abrams, Berdo & Goodman

[57] ABSTRACT

An invalid wheelchair/litter having improvements in the areas of a cushioning cylinder that softens the lowering motion from the chair configuration to the litter cnfiguration to protect the patient, providing removeable upholstery which permits use of slip covers and quick and easy cleaning of the apparatus, and improved foot rest structure having numerous advantageous features.

17 Claims, 14 Drawing Figures

FIG. 6
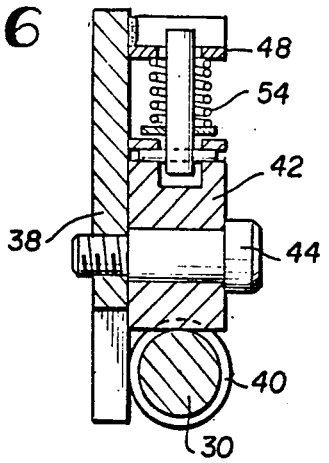
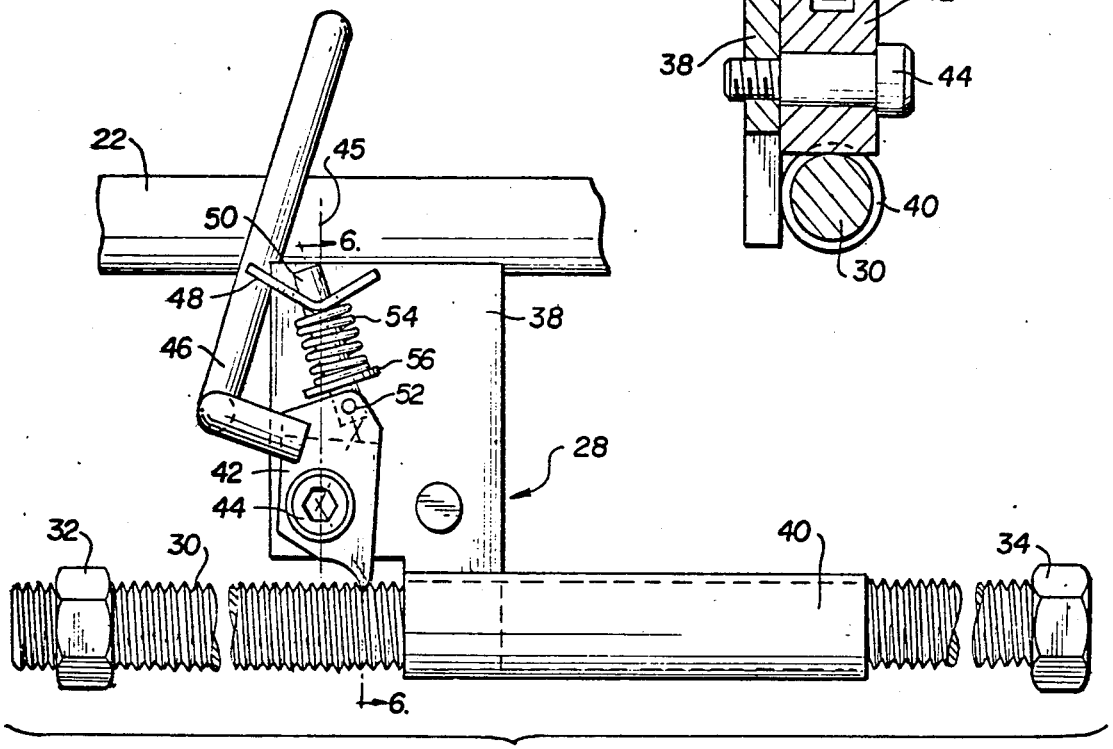
FIG. 5
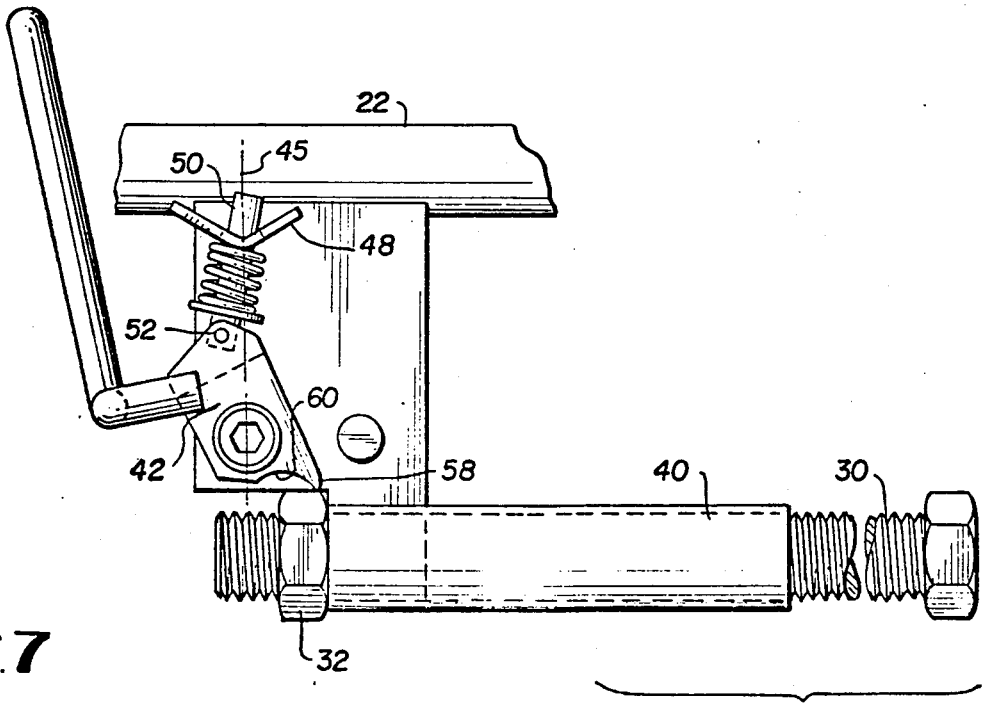
FIG. 7

CONVERTIBLE WHEELCHAIR/LITTER

This is a division of application Ser. No. 673,850 filed Nov. 21, 1984.

FIELD OF INVENTION

This invention relates to apparatus for use by geriatric, seriously ill, invalid, and the like persons, wherein there is a need for a single piece of apparatus in which the patient can sit, and upon which the patient can lie. Further, it is necessary that it be possible to move the patient about while in the apparatus. That is, the invention serves the function of both a hospital litter and a wheelchair.

PROBLEMS IN THE PRIOR ART

The present invention is a substantial step forward in this art in that it provides an improved convertible chair/litter of the character described which will permit several advantageous features in use.

An important area of use has to do with emergency situations. That is, assuming the patient is using the apparatus in the wheelchair configuration, and an emergency such as a heart attack or the like should arise, it then becomes necessary to rapidly move the patient from the chair to the litter position. This presents numerous problems in the prior art.

One such area has to do with the foot rests. It has been long known in this art to provide independently operable foot rests in order to accommodate a patient having a need to have one leg higher than the other, i.e., gout, broken bone in that leg limb, or the like. When it becomes necessary to rapidly change the configuration of the apparatus from chair to litter, independently operated foot rests could cause a delay. That is, it might be necessary for attending personnel to take valuable, possibly life-endangering time, to make adjustments or changes in the foot rests left and right independently, before being able to move from the chair to litter configuration. This problem is overcome by the invention apparatus as set forth below.

Another area has to do with permitting relatively rapid motion from the chair to litter for emergency purposes, while at the same time providing means to comfortably cushion the reverse motion from litter to chair so as to ease the work of the attendant while at the same time assuring that the apparatus will not rapidly go into the chair configuration as it naturally tends to do due to the weight of the patient. That is, the structural arrangement is such that when in the litter configuration certain parts of the apparatus, primarily the seat, carrying the bulk of the weight of the patient are at a higher level than they are in the chair configuration. If these cushioning means were not provided, it is possible that an unduly rapid motion of the apparatus could result, which unduly rapid motion could result in severe upsetting of the patient, and even throwing of the patient out of the apparatus. Preventing this, in the prior art, required the operator to use his strength to hold back against the weight to gently move the patient. The cushioning arrangement of the invention thus saves effort by the operator or attendant, while assuring no such potentially dangerous operation in the motion into the chair configuration.

At the same time, this cushioning is such that the desired rapid emergency motion can be achieved, that is, motion from chair to litter configuration.

Yet another area has to do with cleanliness of apparatuses of this sort. When dealing with geriatric or incontinent patients, there is a severe problem concerning food, vomit, body wastes, and the like getting on the apparatus. These waste materials must be removed from the chair in order to not create a health hazard. In some medical situations it is necessary to frequently do such cleaning. This aspect of the invention is applicable to other types of seating equipment, such as conventional chairs and wheel chairs, geriatric chairs, aircraft seats, and the like.

The present invention provides improved means to permit this cleaning, while also providing other advantages as to hygiene, all as set forth below.

SUMMARY OF THE INVENTION

The present invention provides a convertible wheelchair/litter of the character described which solves all of the above problems, and which provides yet further advantages over the prior art in general.

In the area of the foot rests, each foot rest is provided with a rachet type adjusting arrangement based on a relatively fine screw thread. A pawl cooperates with this thread to permit a great range of different adjustments. That is, each turn of the screw thread on the rod cooperating with the pawl corresponds to a separate adjusted position.

In the motion from chair to litter with the two foot rests at different adjusted positions, means are provided cooperable with the foot rests to lift the pawls off of the respective screw threads to permit the two foot rests to also go into the litter configuration. Absolutely no adjustment or attention need be paid by the attendant or the operator to the foot rests during this emergency move. This is an extremely important advantage of the invention, since, as when dealing with heart attacks or the like, seconds can make the difference between life and death.

Further as to the foot rests, when it is again necessary to return this particular patient while still on the apparatus back to the chair configuration from the litter configuration, the foot rests will go back to vertical. Each foot rest includes an over-center latch arrangement which is automatically switched into release when that foot rest is moved up into litter configuration. Thereafter, when the device is moved back to the chair position the foot rests will automatically go all the way down to the vertical, normal seating position since the rachet was automatically released in litter position.

As to the cushioning means, the invention in this area comprises a cylinder which may be pneumatic or hydraulic, and which includes a relief area on the piston rod, and a slidable piston mounted on the rod and spring loaded to one position with respect to the relief area. The arrangement of parts is such that in one position the spring loaded piston will block the relief slot on the piston rod, thus assuring the full dampening effect of the cylinder overall on the motion of the apparatus from the litter to the chair configuration. When the apparatus is moved in the opposite direction, from chair to litter which would occur in the event of an emergency, in that case the piston is urged to open up the relief slot, thus allowing the working fluid, air or oil, to bypass the piston to a substantial extent, thus providing virtually no dampening action on the motion of the apparatus in this direction, i.e., from chair to litter. No dampening is required by the attendant, since in this direction, moving the invention apparatus with the patient therein from chair to litter, the attendant must expend energy to in effect raise the weight of the patient against gravity.

As to the hygiene aspect, the present invention provides means to permit quick removal of the seat cushion and the back cushion from the apparatus. The remainder of the apparatus other than these two major upholstered portions is made of stainless steel, chrome plated steel, and other materials which can withstand water. Thus, if the patient has soiled the apparatus, the two major upholstered pieces are quickly and easily removed, permitting their separate cleaning away from the apparatus, and permitting cleaning of the remainder of the apparatus, the metal framework and other parts, by, if desired, simply hosing down tht major apparatus.

Other advantages flowing from the quick removal of the seat and back include that the upholstery can be easily repaired in the event it is damaged or worn, the upholstery can be easily changed, no crevices, folds and the like in the upholstered parts of the apparatus are created, and this quickly removable upholstery lends itself to use with covers. That is, if a hospital has such an apparatus and will sometimes use it with a patient who will not soil the apparatus and sometimes use it with a patient likely to soil the chair/litter, then for the second patient the hospital could put a disposable cover on the upholstery which in the event of need can be simply removed, discarded and replaced for later use with other such patients. The ordinary upholstery could be used for normal patients without any such cover. This is a virtually unheard of advantage in hospital equipment of the character of the present invention, and in use on other types of seating equipment with which this aspect of the invention can be used.

Overall then, it can be seen that the present invention provides a convertible chair/litter for the environments described above which is a substantial step forward in this art, solves several long standing problems in the prior art, provides many heretofore unknown advantages in this type of apparatus, and which is yet simply and reliable in operation, and strong, practical, durable, and highly suited to its use.

BRIEF DESCRIPTION OF THE DRAWINGS

FIG. 5 is a detailed showing of the foot rests operating mechanism;

FIG. 6 is a cross-sectional view taken on line 6—6 of FIG. 5;

FIG. 7 is a view similar to FIG. 5 showing the automatic unlocking action of the foot rests;

DETAILED DESCRIPTION OF THE PREFERRED EMBODIMENT

Figure 1:
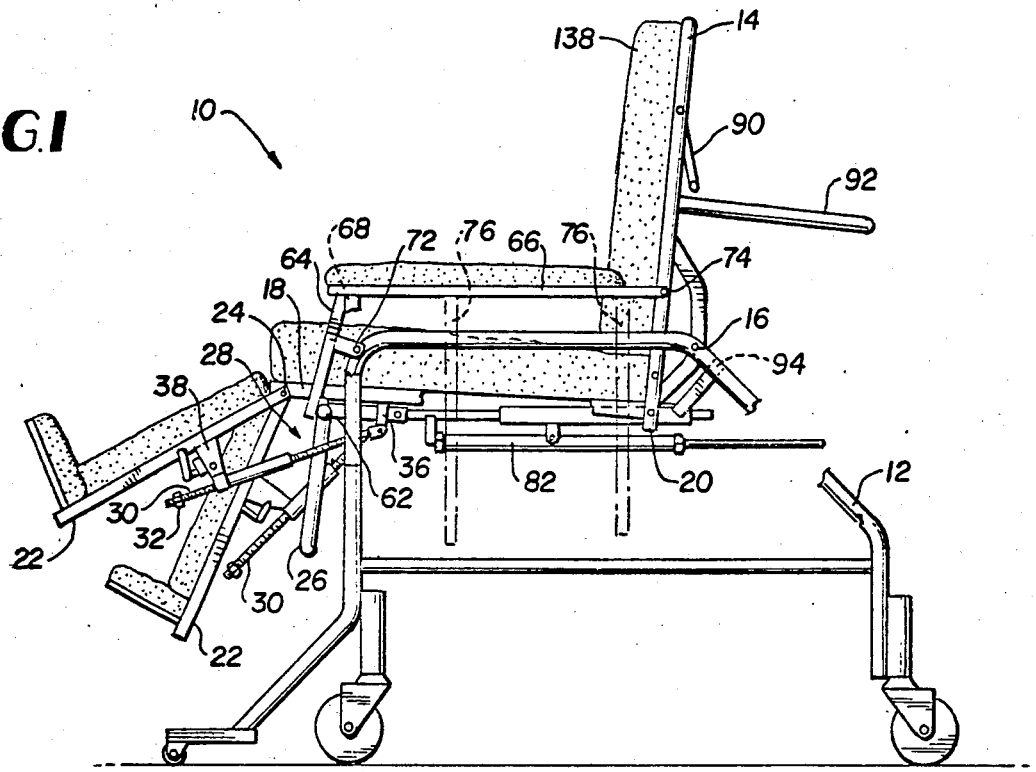
FIG. 1 is a side elevational view with some parts broken away, some parts shown in dotted lines, and some parts omitted for the sake of clarity, showing a preferred embodiment of a convertible wheelchair/litter according to the invention.

FIG. 1 shows a convertible wheelchair/litter in accordance with the invention. The device is built about a framework 12 having wheels and means to mount all of the other portions, the framework itself not forming a material part of the present invention except as support for the various other parts described below.

Figure 10:
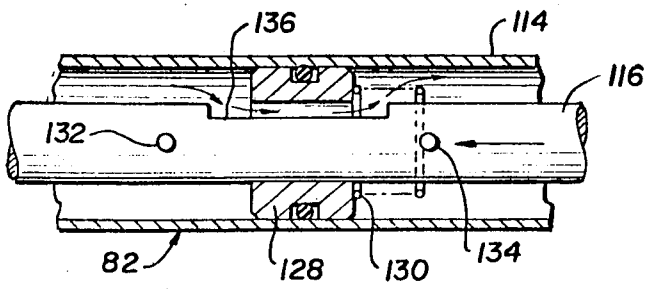
FIG. 10 is a view similar to part of FIG. 9 showing another position of the piston in the cushioning cylinder.

A back rest framework 14, see also FIG. 10, is pivotally mounted to the frame 12 at pivots 16. A pair of seat frame members 18 are pivoted at the rear ends to their bottom of the back rest framework 14 at pivot points 20, which can be in the form of cross bars, see FIG. 14. Left and right foot rests 22 are pivoted at their upper ends to their respective left and right seat frame members 18. The foot rests 22 are symmetrical but otherwise identical to each other.

Figure 2:
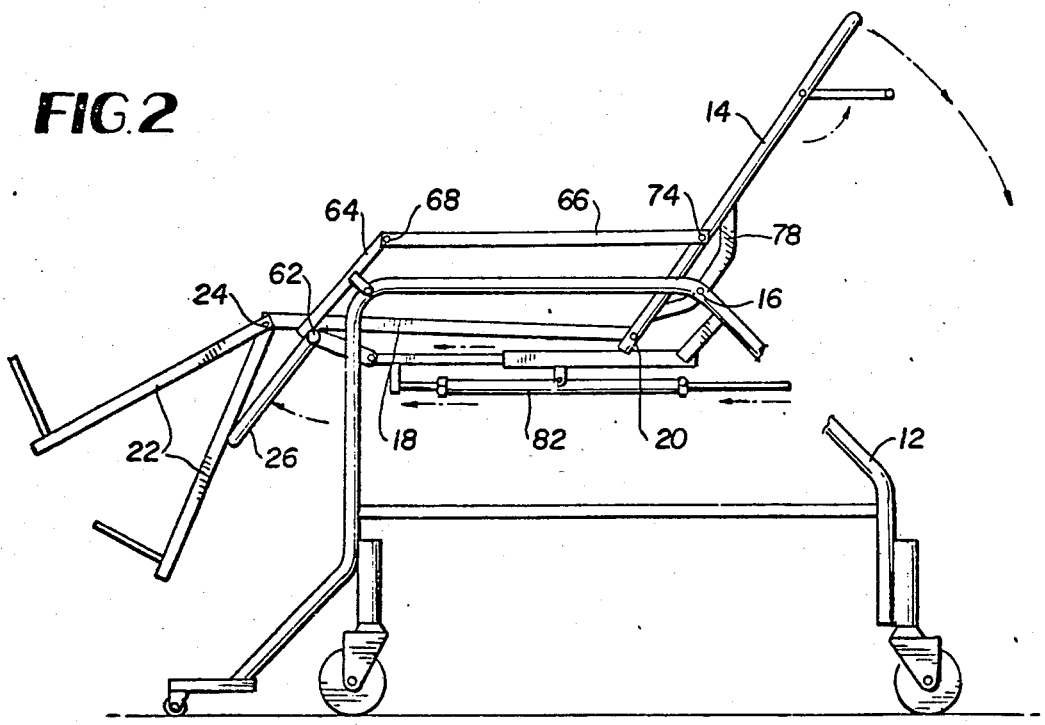
FIGS. 2, 3 and 4 are a family of drawings showing the wheelchair/litter of FIG. 1 with additional parts removed, and showing the operation moving from the chair position of FIG. 1 to the litter position of FIG. 4.
Figure 3:
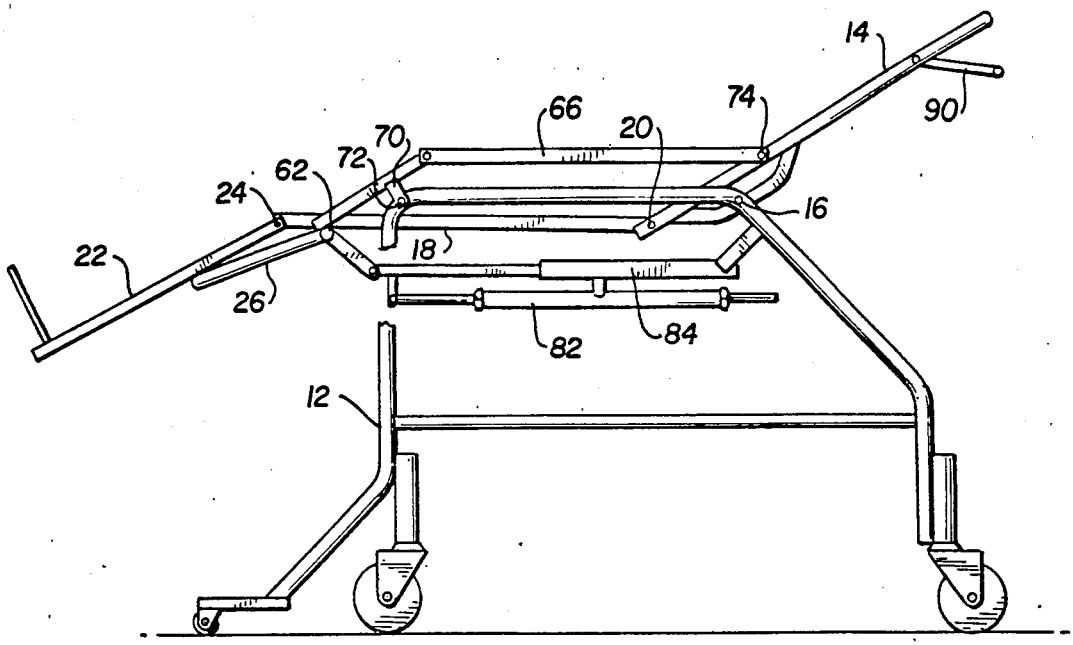
Figure 4:
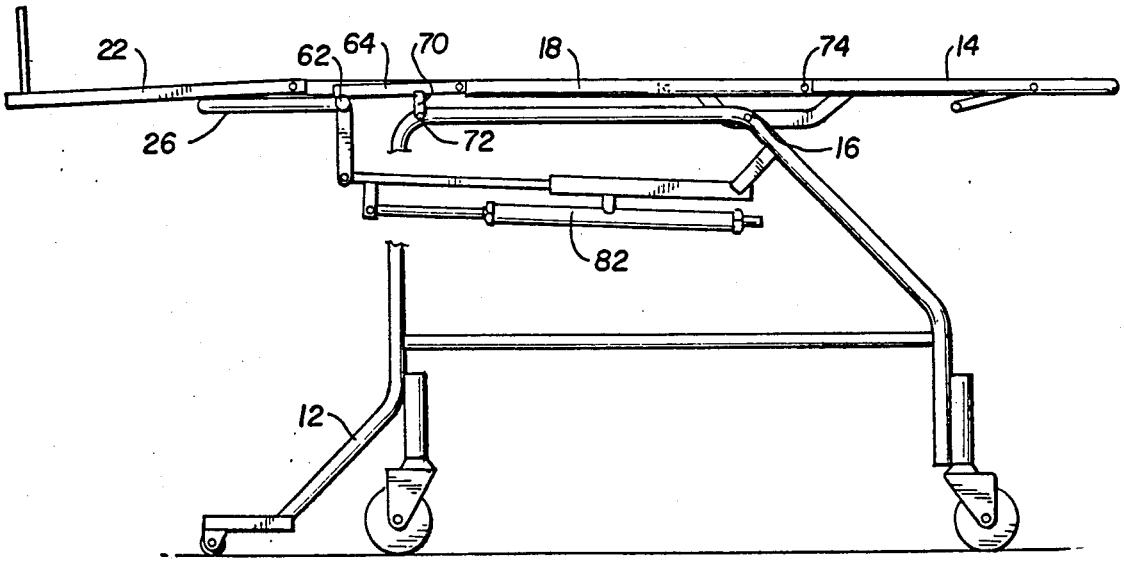

Means are provided to lift the foot rests 22 when moving from the chair configuration of FIG. 1 into the litter configuration of FIG. 4, and to thereafter permit the foot rests to return to the normal vertical unadjusted position when the chair is again moved back from the litter to the chair configuration. To this end there is provided a foot rest lifting bar 26 which is connected to and operated by the guide cylinder and cushioning cylinder arrangement by means and in a manner described below. This bar 26 is caused to swing upwardly and to the left as shown in the drawings to progressively move both foot rests together up to the litter position. The action is depicted by the sequence of FIGS. 2, 3 and 4.

Cooperating with the lifting action of the foot rest lift bar 26, the foot rests 22 themselves are mounted to the seat frame 18 by the way of a foot rest adjusting assembly 28, best seen in FIGS. 1 and 5–7. Each assembly 28 includes an elongated adjusting screw 30, having an adjusting nut or stop member 32 at one end and a securing nut 34 at the opposite end which fixes that end of the adjusting screw 30 to a bracket 36 fixed to the underside of the seat 18.

Means to guide each foot rest's motion on the individual screws 30 and to adjust the position of the foot rests with respect to the seat are provided. These means comprise a bracket 38 to which the other parts are mounted, including a guide sleeve 40 at the lower end of the bracket 38. This sleeve 40 as shown in FIG. 5 snugly but slidingly receives the adjusting screw 30.

Bracket 40 carries a pawl 42 pivotedly mounted to the bracket at a pivot 44. Pawl 42 carries a manual operating lever 46 to permit the operator to change the position of the pawl.

FIG. 5 shows arbitrary adjusted positions of the foot rests 22, for example, the position of the left hand foot rest in FIG. 1. FIG. 7 shows the position of the foot rests apparatus in the litter position of the invention device as shown in FIG. 4. Means are provided to hold the pawl 42 in either the adjusted position of FIG. 5 or the release position of FIG. 7, whichever position the pawl is in. These means comprise an over-center spring arrangement, the operation of which can be easily seen by reference to the imaginary line 45 shown in FIGS. 5 and 7.

This over-center spring arrangement comprises an upper bracket 48 which is welded or otherwise secured to the side of the bracket 38. An over-center pin fits in a snug opening in the bracket 48 at one end, and has its other end pivoted as at 52 to the upper end of the pawl 42. A spring arrangement 54 is constrained between the bracket 48 and a stop shoulder 56 on the pin 50 to strongly urge the pawl to the over-center position to the right of line 45 in FIG. 5 or the other over-center position to the left of line 46 as shown in FIG. 7. The pawl tooth 58 at the lower end of the pawl 42 is defined by a cut-out 60.

The operation of this structure is that the nut 32, as the apparatus moves from the sitting position of FIG. 5 to the litter position of FIG. 7 strikes against the cut-out 60, thus throwing the over-center apparatus from the right hand position of FIG. 5 to the left hand position of FIG. 6, thus automatically disengaging the tooth 58 from the threads of the adjusting screw 30 upon reaching the litter position.

The foot rest structure as shown in FIGS. 5–7 and described above, also has the advantage that it permits racheting from lower positions to higher adjusted positions. That is, imagining that the user has adjusted the right hand foot rest to the relatively low position shown in FIG. 1, and it should now be necessary or desirable to adjust that right hand leg rest to a higher position such as that shown by the left hand leg rest, the over-center to the right arrangement shown in FIG. 5 will permit such racheting, the spring 54 taking up the slight amount of motion of the pawl caused by the tooth 58 passing over each individual screw thread. The parts are configured so that the height of the thread is insufficient to throw over the over-center arrangement, the motion caused by going over the thread is merely absorbed by the spring. The height of the nut, however, is sufficient to "kick" the over-center apparatus over to the left, as shown in FIG. 7.

Thus, the leg rests can be set to an adjusted position using the manual handle 46, and higher adjusted positions can be automatically set by simply lifting the foot rests without having to further manually adjust. However, lower adjusted positions will require the operator to release the handle. The operator can take advantage of the racheting arrangement even in this situation, by simply lowering the foot rests to the bottom, re-engaging it at the bottom, and then racheting it up one or two or three threads at a time until the patient is comfortable.

Another advantage is provided by the nut 32 which operates the pawl 42. By simply moving the nut along the threads, the parts are configured to the proper operation, and causing the foot rests to arrive at the proper horizontal litter position.

The diameter of the pin 50 with respect to the opening in the bracket 48 is such as to create an imaginary point or line of pivot of the pin 50 in the bracket 48, and this line is perpendicular to and coincident with the line 45, the imaginary over-center line of the mechanism of the pin 50 and the pawl 42. That is, the center line of the pin 50 and the imaginary over-center line 45 are coincident at that point in the travel of the mechanism which corresponds to the "on center" position of the over-center device. In use, of course, the center line of the pin 50 will always be to the right as shown in FIG. 5 or else in the other unlocked position to the left as shown in FIG. 7 with respect to the imaginary center line 45.

Means are provided to control the motion of the invention wheelchair/litter between the chair position of FIG. 1 and the litter position of FIG. 4, and to also control the operation of the foot rest lift bar 26 in the manner described above.

Figure 8:
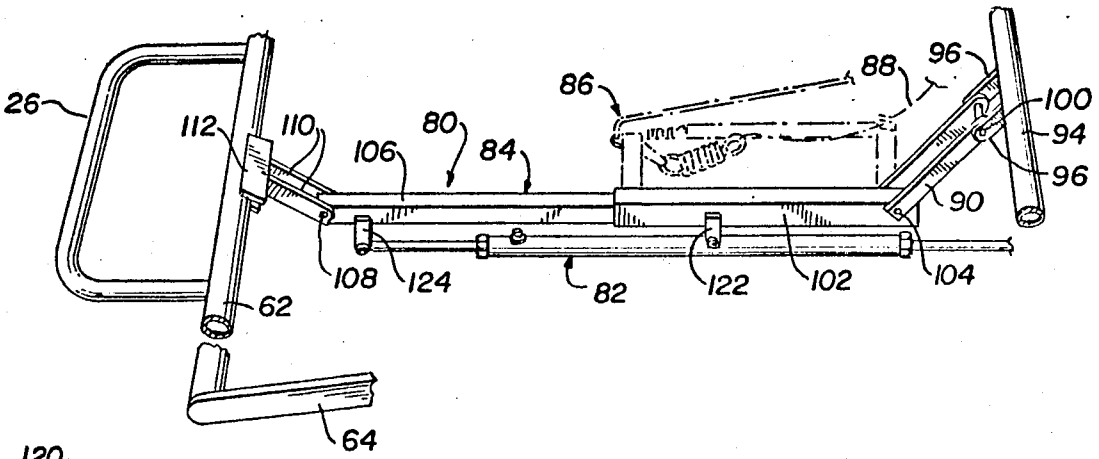
FIG. 8 is a perspective view of part of the chair of FIGS. 1–4 showing the cushioning cylinder, this view being taken looking downwardly from above the seat.

To this end, referring to FIGS. 1–4 and 8 and especially FIGS. 1 and 8, an intermediate bar 62 is provided. The foot rest lift bar which is of "U" configuration has its ends joined as by welding to the center portion of this intermediate bar 62. At its outer ends, one of which is shown in FIG. 8, there is provided a pair of extension bars 64 which extend upwardly from the intermediate bar 62 and which join to arm rest bars 66 at pivot points 68. Intermediate its ends, the extension bar 64 carries a pivot link member 70 rigidly fixed thereto, the outer end of which is pivoted as at 72 to the top forward corner of the main framework 12.

The rear ends of the two arm rest bars 66 are pivoted to the back rest frame 14 as at 74. Each arm rest bar 66 carries a pair of vertical guide bars 76 which are guided by means not shown for vertical motion with respect to the main framework 12 in order to assure that the arm rests remain essentially horizontal during motion, as seen from the set of "action" drawings FIGS. 1–4. These elements 76 have been eliminated in FIGS. 2, 3 and 4 for clarity.

The back rest frame 14 carries a pair of brackets 78 which are fitted to pivot points 16 at the upper rear corner of the main framework 12.

Thus, it can be seen that the entire mechanism pivots at the points 16 and 72, provided on the left and right sides, on the main framework 12. The linkage also includes the arm rest bars 66 and seat bars 18 which make up the horizontal parts of the linkage. At their rear ends, these bars are pivoted at 74 and 20 respectively both to the back rest frame 14. At their front ends, the linkage includes the extension bar 64 pivoted at its upper end at 68 to the arm rest bar 66, and to its lower end to the intermediate bar 62. Intermediate bar 62 supports the front end of the seat bars 18, the bars 18 simply resting on bar 62.

Means are provided to control the motion of this linkage between the litter and chair positions in a certain manner, and to also provide means to cushion the motion and help take up the weight when moving from the litter position of FIG. 4 down to the chair position of FIG. 1, while at the same time having no effect on the motion in the opposite direction from chair to litter so as to not unduly further burden the operator.

To this end, there is provided an assembly 80 comprising a cushioning cylinder 82 and a guide cylinder 84. The guide cylinder 84 is made of a pair of nested tubes of square or rectangular cross section and are relatively heavy and durable as they include means to lock the mechanism in the various adjusted positions shown in FIGS. 2, 3 and 4, as well as to serve as part of the linkage to take up the weight of the patient and of the mechanism itself. The locking assembly 86 is shown in phantom lines as it does not form a material part of the present invention. It includes a control cable 88 which leads up to a trigger or release bar 90 pivoted to the upper end of the back rest frame 14 in a closely spaced convenient position to a push bar 92.

Thus, as is obvious, an attendant can manipulate the invention device when in the chair configuration by handling the push bar 92, while at the same time his hands are conveniently located with respect to the trigger 90 to change the adjusted position of the invention wheelchair/litter.

Referring to FIGS. 1 and 8, a bar 94 is rigidly attached to the two main side frames 12 and extends therebetween, perpendicular to the paper as seen in FIG. 1. Bar 94 carries a pair of relatively short bars 96 to which another pair of bars 98 are pivoted as at 100. The rear end of the housing portion 102 of the guide cylinder 84 is pivoted to the lower end of the bars 98 at pivots 104. The guide cylinder 84 also includes a moving portion 106 nested within the housing portion 102, and the outer free end of the moving portion 106 is pivoted as at 108 to a yoke 110 which is rigidly fixed by way of a bracket 112 to the intermediate bar 62. The moving part 106 simply slides within the housing part 102, no hydraulic or other working fluid being provided therebetween.

The cushioning function is provided by the cushioning cylinder 82 which comprises a cylinder housing 114 and a guide rod 116. Packing means 118 are provided at both ends of the cylinder housing 114 to seal the working fluid therein. A fill tube 120 is provided to "top up" the oil or air used as the working fluid in the cushioning cylinder 82. The rod 116 is considerably longer than the housing 114; at the minimum, by an amount equal to the throw or travel of this cylinder in moving from the seat position of FIG. 1 to the litter position of FIG. 4. The cushioning cylinder 82 is functionally joined to the linkage by way of bracket 122 which joins the stationery housing 102 of the guide cylinder 84 to the stationery housing 114 of the cushioning cylinder 82. In a similar manner, a bracket 124 is fixed as by an opening 126 to the forward end of the rod 116 and to the moving guide cylinder 106 of the guide cylinder assembly 84.

A piston 128 is provided inside the housing 114 in closely spaced position to the housing and to the rod 116 for motion with respect to both elements 114 and 116. A spring 130 urges the piston 128 to the left against a stop pin 132. Another stop pin 134 constrains the spring 130 between the piston 128 and itself. The rod 116 is formed with a cut-out 136, and the piston 128 moves with respect to this cut-out 136 between the positions of FIGS. 9 and 10 and adjusted positions therebetween.

While the drawings in FIG. 8 and the description herein describes the housing 114 of the cushioning cylinder 82 as being fixed while the rod is moved in conjunction with the motion of the linkage, the opposite arrangement of parts is also possible. That is, the rod end could be fixed to a non-moving part of the invention wheelchiar/litter, while the cylinder housing 114 could be arranged to be the moving part. Such a rearrangement of parts might be desirable in some other embodiments of the the present invention.

Figure 9:
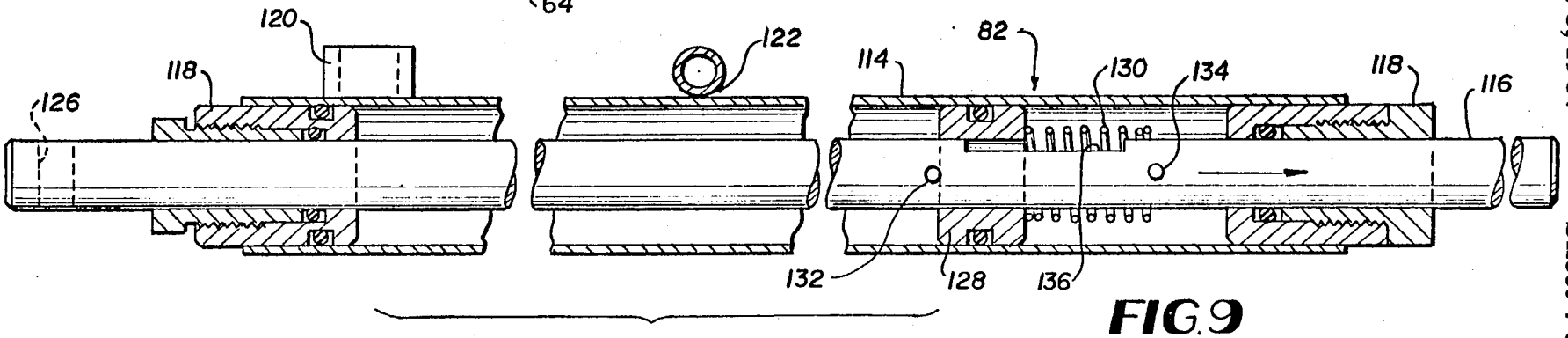
FIG. 9 is a longitudinal cross-sectional view partly broken away of the cushioning cylinder.

As to the operation of this part of the invention, the arrow on the rod 16 in FIG. 9 indicates motion to the right which corresponds to lowering from litter to chair. In this motion it is necessary to cushion the action of the linkage in order to gently lower the patient. The weight of the patient, together with the weight of the mechanism itself, when lowering to the chair position from the litter position absent the cushioning provided by the cylinder 82, is sufficient to upset the patient, to move him violently, and in fact to even literally throw the patient out of the mechanism.

Referring to FIGS. 9 and 10 with this background, it can be seen that when moving to this lowered position, to the right as shown in FIG. 9, then the spring 130 urges the piston against the stop 132, thus effectively trapping the working fluid between the piston 128 and the right hand packing 118. This has a cushioning effect as the working fluid leaks very slowly between the relatively tight fit between the left hand side of the piston 128 and the part of the rod 116 between the stop 132 and the cut-out 136, that is the part of the rod which is not cut out. When moving in the opposite direction as indicated by the arrow on rod 116 in FIG. 10, then the piston motion to the right as urged by the trapped working fluid to the left of the piston 128, is sufficient to push the piston against the spring 130, to push it to its fully compressed length, which completely opens up the cut-out or fluid bypass 136. Thus, there is no cushioning or dampening effect at all, the working fluid is free to pass what amounts to through the piston 128 via the cut-out 136 to provide no such dampening.

Figure 11:
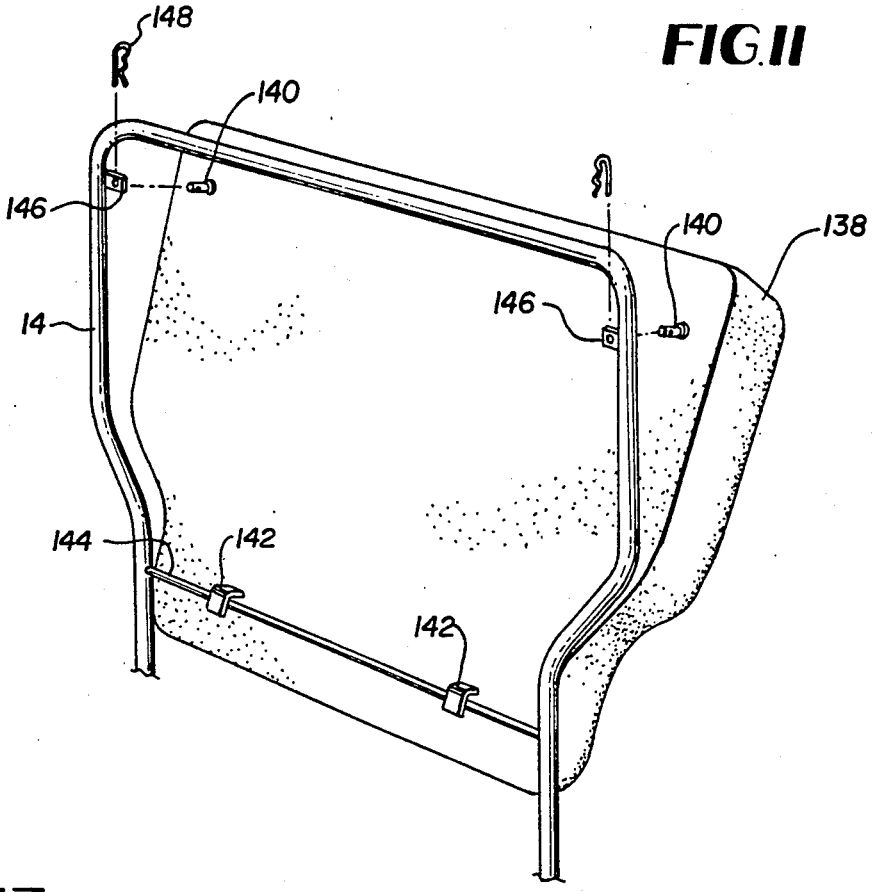
FIG. 11 is an exploded view showing the manner of mounting the back rest of the device of FIG. 1.
Figure 13:
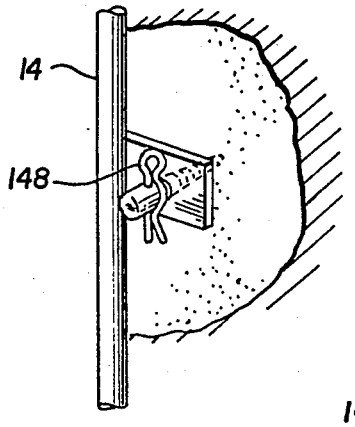
FIG. 13 is a view of a detail of FIG. 11.
Figure 12:
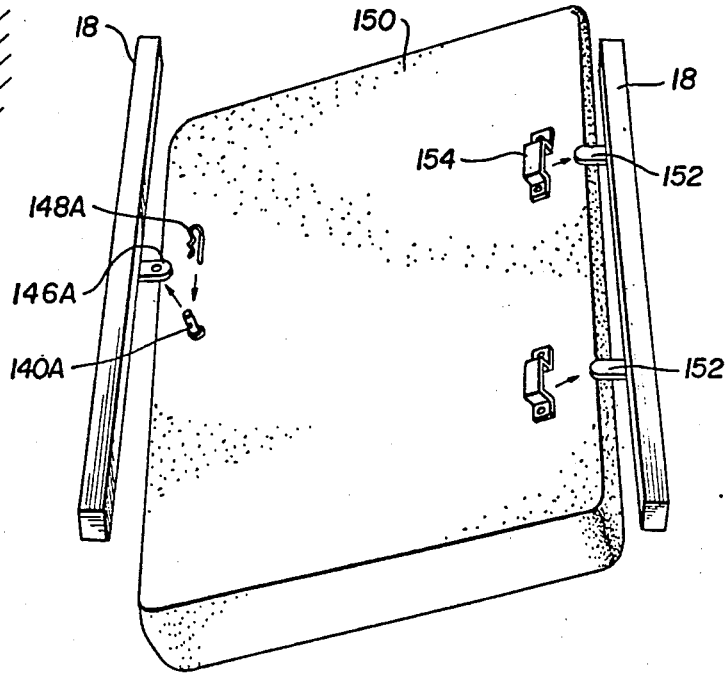
FIG. 12 is an exploded perspective view similar to FIG. 10 showing the mounting of the seat.

In FIGS. 11, 12 and 13, the removeable upholstery feature of the present invention is shown. Many parts have been omitted from these drawings, especially from the linkage, for the sake of clarity, and since such parts are not necessary for understanding this feature.

The back rest 138 itself includes a pair of pins 140 at the upper corners thereof and a pair of hanger brackets 142 at the lower end thereof. The back rest frame 14 carries a bar 144 over which the fingers 142 can be easily fit, the fitting motion being shown in FIG. 11. At its upper end, just below the upper-most corners and closely adjacent thereto, the frame 14 carries a pair of tabs 146 which cooperate with the pins 140, and can be locked therein as shown in FIG. 13 by cotter pins 148.

The manner in which the seat member 150 is mounted to the seat bars 118 of the framework is shown in FIG. 12. This view is upside down, i.e., one could imagine oneself as lying on the floor looking up to the operator mounting the seat into the framework. The seat carries a pin 140A which cooperates with a tab 146A on one of the seat bars 18, and the companion seat bar carries a pair of tabs 152 which fit into "U" shaped brackets 154. The pin 140A and brackets 154 are, of course, on the underside of the seat 150.

The manner in which the seat and back both quick mount and dismount from the respective frameworks 14 and 18 should not be evident. In the case of the back, the fingers 142 are slipped over the bar 144, and the seat brought forward to insert the pins 140 through the tabs 146 to be locked in place by the cotter pins 148. In a similar manner, working from above, the brackets 154 are slipped over the tabs 152, the pin 140A lowered into the tab 146A, and the cotter pin 148 inserted to secure the assemblage.

This structure provides numerous advantages over the prior art, including rapid cleaning, and permitting the use of slip covers, such slip covers not being shown as they are per se well known, i.e., analogous to fitted bed sheets, the slip covers can have elastic edges that fit over and around the respective back rest 138 and seat 150.

Figure 14:
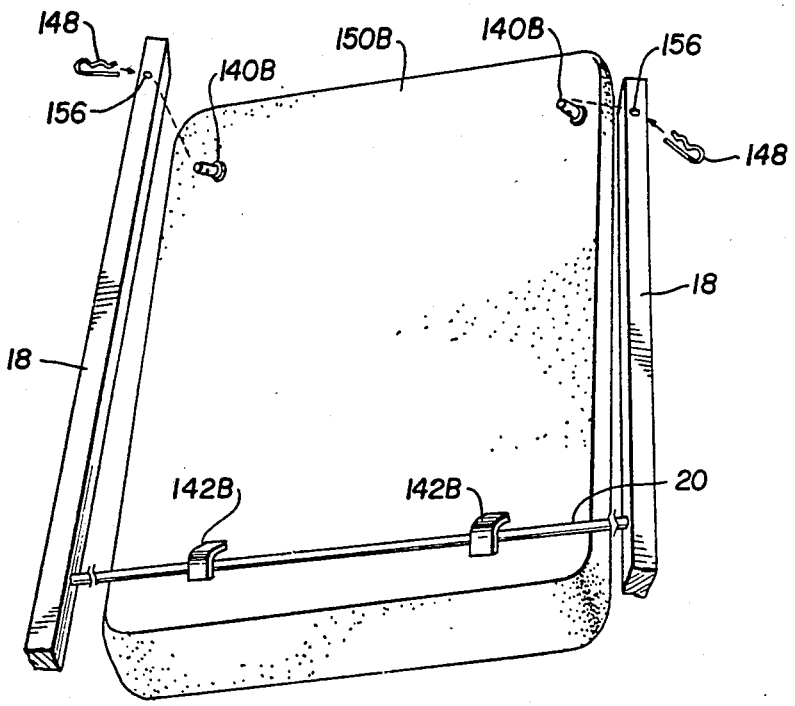
FIG. 14 is a view similar to FIG. 12 showing a variation of the seat mounting structure.

Referring to FIG. 14, there is shown another variation wherein the quick-release concept used for the back rest can be adapted for use with the seat cushion. Parts similar to or the same as those shown in earlier Figures and described above are indicated by the same reference numerals followed by "B".

Seat frame members 18 are formed with holes 156 which receive pins 140B on the seat 150, and fingers 142B fit over pivot bar 20 (see also FIG. 2). Cotter pins 148 secure the asemblage. The operation is analogous to that described above for the back seat and as shown in FIG. 11.

This removable upholstery feature of the invention is not limited to use on convertible equipment, but can be used on seating equipment in general, such as regular wheel chairs and geriatric chairs; and even outside the health care environment such as in aircraft and on other vehicles and on conventional furniture, for both business and home use.

Thus, as can been seen from the above, it is a relatively simple matter to remove or replace one or both of the back rest cushion or the seat cushion without the use of any tools whatsoever, in all of the FIGS. 11-14 embodiments of the invention.

The cotter pins 148 constitute manual locking means to hold the cushions in place. Likewise, the fingers 142 and the brackets 154 are functionally quick release holding means to hold the back rest and the seat cushion, respectively, in their respective places on the seating equipment.

The remaining parts of the upholstery as shown in FIG. 1 on the arm rests and on the foot rests, can be permanent or removeable, and, in any case, are easily cleaned, if needed, after the seat and back rest are removed using the invention's advantageous quick release features described above.

While the invention has been described in detail above, it is to be understood that this detailed description is by way of example only, and the protection granted is to be limited only within the spirit of the invention and the scope of the following claims.

I claim:

1. In seating equipment, the combination comprising upholstered cushion means, means to permit rapid assembly and disassembly of said upholstered cushion means from said seating equipment without the use of tools, said seating equipment comprising frame portions cooperable with said upholstered cushion means, said assembly and disassembly means comprising pin means on said upholstered cushion means and tab means formed with openings adapted to receive said pin means, means to mount said tab means on said cooperating frame portions, and manually removable locking means to removable secure said pin means in said openings in said tab means, whereby said assembly and disassembly means comprises quick release holding means between said upholstered cushion means and said cooperating frame portions.

2. The combination of claim 1, said upholstered cushion means comprising a seat cushion, said assembly and disassembly means comprising bracket means fixed to the underside of said seat cushion and tab means fixed to the seat portion of said frame portions, said tab means being adapted to slide into and out of said bracket means, and said pin means comprising a single pin fixed to the underside of said seat cushion opposite said bracket means.

3. The combination of claim 1, said upholstered cushion means comprising a back rest, said assembly and disassembly means comprising finger means fixed to said back rest in closely spaced relation to the lower end thereof and a bar member fixed to the back portion of said frame portions, said finger means adapted to fit over said bar member, and said pin means being fixed to said back rest in closely spaced relation to the upper end thereof.

4. The combination of claim 1, said upholstered cushion means comprising a seat cushion, said assembly and disassembly means comprising pin means and finger means on said seat cushion, said seating equipment frame portions including a bar member cooperable with said finger means, said last mentioned frame portions being formed with openings, said pin means being receivable in said openings, manually removeable locking means to removably secure said pin means in said frame portion openings, and said pin means and said finger means being positioned on said seat cushion on opposite sides of the rear surface thereof.

5. The combination of claim 1, said seating equipment comprising a convertible wheelchair/litter.

6. The combination of claim 1, said seating equipment comprising a geriatric chair.

7. The combination of claim 1, said seating equipment comprising a conventional wheelchair.

8. The combination of claim 2, said seating equipment comprising a convertible wheelchair/litter having chair and litter configurations, the combination comprising a seat portion located at a seat height in the chair configuration of said wheelchair/litter and located at a litter height in the litter configuration of said wheelchair/litter, said litter height being above said seat height, linkage means to permit motion of said wheelchair/litter between said chair and litter configurations, automatically operating cushion cylinder means associated with said linkage means and said seat portion, said cushion cylinder means comprising means to automatically cushion the downward motion of said linkage means and of said seat portion from said litter height down to said seat height, and said cushion cylinder means comprising means to automatically cause said cushion cylinder means to have substantially no effect on said linkage means when said linkage means and said seat portion are moved upwardly from said seat height to said litter height.

9. The combination of claim 8, said cushion cylinder means comprising a housing, a piston rod, packing means at the ends of said housing to seal working fluid inside said housing to substantially fill said housing, said packing means also sealing around said piston rod to permit motion of said rod through said housing and said working fluid, means to secure one of said housing and said piston rod to a portion of said wheelchair/litter which does not move with said linkage means, means to secure the other of said housing and said piston rod to a portion of said linkage means, said automatically operating means comprising a piston member mounted on said piston rod inside said housing for motion relative to both said housing and said piston rod, means to cause said piston to impede the motion of said working fluid in one direction from one side thereof to the other side thereof when moving said seat portion downwardly from said litter height to said seat height, and means to cause said piston not to impede said flow of working fluid in the opposite direction when moving said seat portion upwardly from seat height to litter height.

10. The combination of claim 9, said last mentioned means comprising a cut-out formed in said piston rod, first and second stop means defining the limits of motion of said piston on said rod with respect to said cut-out, and spring means normally urging said piston against one of said stop means, the arrangement of parts being such that said piston blocks the flow of working fluid through said cut-out in said one direction and permits the flow of working fluid through said cut-out in said opposite direction.

11. The combination of claim 2, said seating equipment comprising a convertible wheelchair/litter having chair and litter configurations, the combination comprising separate left and right foot rests, said wheelchair/litter comprising a seat portion, means to pivotally mount the upper end of each said foot rest to said seat portion, means to separately adjust the position of each said foot rest about said pivot to said seat portion when said wheelchair/litter is in the chair configuration at a location between and including the extremes of a substantially vertical position and a substantially horizontal position and at any one of a relatively large plurality of positions therebetween, linkage means to control the motion of said wheelchair/litter between its wheelchair and litter configurations, said linkage means comprising means to move said left and right foot rests from any one of their separate adjusted positions about their pivots to said seat portion to the substantially horizontal position when said wheelchair/litter is moved from the chair to the litter configuration.

12. The combination of claim 11, and said foot rest adjusting means comprising rachet means so arranged that said foot rests are so moved automatically into their said substantially horizontal positions without any handling by an operator during said motion of said wheelchair/litter from chair to litter configuration.

13. The combination of claim 11, said foot rest adjusting means comprising rachet means and said rachet means permitting re-adjustment of the position of each said foot rest from any first adjusted position to any second adjusted position closer to horizontal than said first position without any manipulations of any part of said wheelchair/litter other than simply lifting said foot rest towards horizontal about its pivot to said seat portion.

14. The combination of claim 13, each said rachet means comprising an elongated screw threaded member, means to pivotedly mount one end of said screw threaded member at a fixed location on said seat portion, a sleeve member slidably mounted on said screw threaded member, a bracket fixed to both said sleeve member and said foot rest, and a rachet point pivotally mounted on said bracket and engaging said screw threaded member.

15. The combination of claim 14, and spring loaded two position over-center locking means on said bracket arranged to in one position hold said pawl engaged with said screw threaded member and in its other position to hold said pawl out of engagement with said screw threaded member.

16. The combination of claim 15, and a stop member mounted at the free end of said screw threaded member, said pawl and said stop member being so configured that when said foot rest reaches said substantially horizontal position said stop member will engage said pawl and will move said pawl and said over-center locking means to said other position wherein said pawl is disengaged from said screw threaded member, whereby when said wheelchair/litter is moved back to said chair configuration said foot rests will return to their said substantially vertical positions.

17. The combination of claim 12, said linkage means comprising a lift bar so arranged as to engage the undersides of both of said foot rests during said motion of said wheelchair/litter from chair to litter configuration to perform said automatic motion of said foot rests.

* * * * *